US005638762A

United States Patent [19]

Chestnutt

[11] Patent Number: 5,638,762

[45] Date of Patent: Jun. 17, 1997

[54] TABLE WITH BUTTRESSED LEG JOINTS

[76] Inventor: Michael James Chestnutt, 2125 Walnut St., Apt. #7, Philadelphia, Pa. 19103

[21] Appl. No.: 423,682

[22] Filed: Apr. 18, 1995

[51] Int. Cl.[6] ..... A47B 3/06

[52] U.S. Cl. ..... 108/153; 403/169; 248/188.91

[58] Field of Search ..... 108/153, 154, 108/155, 160, 187, 188; 403/169, 170, 217; 248/188, 188.1, 188.8, 188.91

[56] References Cited

U.S. PATENT DOCUMENTS

| | | | |
|---|---|---|---|
| 1,876,336 | 9/1932 | McLaughlin | 366/79 |
| 2,822,228 | 2/1958 | Comer | 311/111 |
| 3,032,375 | 5/1962 | Lalandre | 248/188 X |
| 3,160,381 | 12/1964 | Langbaum | 248/188 |
| 3,233,855 | 2/1966 | Rudow et al. | 248/188.91 |
| 3,295,475 | 1/1967 | McClellan | 108/153 |
| 3,366,357 | 1/1968 | Rudow et al. | 248/188 |
| 3,431,871 | 3/1969 | Ellsworth et al. | 248/188.91 X |
| 4,538,526 | 9/1985 | Seeley | 108/155 X |
| 5,163,373 | 11/1992 | Anderson et al. | 108/153 |

FOREIGN PATENT DOCUMENTS

| | | | |
|---|---|---|---|
| 1037751 | 9/1953 | France | 248/188 |
| 3816269 | 11/1989 | Germany . | |

*Primary Examiner*—Peter M. Cuomo

*Assistant Examiner*—Janet M. Wilkens

*Attorney, Agent, or Firm*—Eckert Seamans Cherin & Mellott

[57] ABSTRACT

An article of furniture such as a table has a leg joint formed substantially from a triangular bracing attachment structure coupled between the top of a leg and an underside of the planar top. The top of the leg is not coupled to the planar top directly, the structure forming a triangular brace having an apex at the top of the leg and two apices on the underside of the top, where diverging brace members coupled to the leg are attached. The brace members are disposed in perpendicular planes (e.g., parallel to the edges of the top, such that the triangular brace effectively leans inwardly. Side support members couple adjacent leg joints and provide tension or compression to resist the tendency of the leg to be diverted in a direction perpendicular to the plane of the triangular brace. Preferably the side support members are spaced below the underside of the top, and attach to the joint brace structure but not directly to the leg or to the opposed side support brace. The result is a sturdy structure having an open appearance at the joints.

20 Claims, 15 Drawing Sheets

TABLE WITH BUTTRESSED LEG JOINTS

Background of the Invention

1. Field of the Invention

The invention relates to furniture structures, in particular tables, and concerns an improved supporting structure for a table top, having a buttress arrangement coupling the table top to the legs, preferably with stiffening members disposed between the legs and spaced from the underside of the table top.

2. Prior Art

In tables, desks and similar articles of furniture having a horizontal member supported by legs, joint structures couple the horizontal member or table top to the legs in a manner that holds the legs stationary relative to the table top, usually with the legs aligned perpendicular to a horizontal table top, but also sometimes at an angle relative to vertical. An example is a horizontal rectangular table top having four legs, but other numbers of legs and other configurations for the top are also possible. To hold the table top steady, the joints between the top and the legs need to resist angular displacement of the legs relative to the top, which would allow the table top to wobble.

The legs are usually braced by members that extend laterally from the legs and couple the legs to the table top and/or to the other legs. In one arrangement, the legs are fixed endwise to the underside or edge of the table top, and linear horizontal members spaced well below the table top extend between the legs, either parallel to an edge of the table top or diagonally. The linear members spaced below the table top may interfere with foot or knee room under the table, and insofar as the structures formed are rectangular, they are not well braced against deflection in the manner of a parallelogram.

To provide a more stable structure, diagonal braces can extend from a point on the leg spaced below the underside of the table to a point on the underside of the table spaced from the joint between the top end of the leg and the table top. The diagonal braces typically reside parallel to the plane of the edge of the table top, but could also extend inwardly, for example, diagonally under the table top. Preferably, two diagonal braces are provided in perpendicular planes.

A variation of this is a flange member attached along the underside of the table top, abutting endwise against two legs at a vertical position immediately adjacent the table top. The flange member provides diagonal bracing to an extent that depends on the vertical dimension of the flange member. In many tables, the flange members between the legs form a downwardly opening box attached to the underside of the table top having a depth, for example, of several inches.

The bracing members can be wood, metal or the like, metal bracings and fittings being convenient for attachment and strength. In traditional table structures, an attempt is made to conceal the joint structures between the table top and the legs. Especially where the leg/top joint includes a metal fitting connecting between the leg and the underside of the table top, the metal fitting is generally made inconspicuous. This is for aesthetic and economic reasons. Metal is cold and industrial in appearance, and is generally not preferred for residential or office use. Concealing the fastening and/or bracing structure also eliminates some finishing details, which saves production costs.

However, metal furniture assembly fasteners are strong and durable, and generally can be attached to the underside of a horizontal planar support and/or the inside surface of the side supports using simple screws or bolts. The leg constructions and fasteners structurally work independently of one another, typically being weakest at the points where they are attached. Several types of metal fasteners used in combination with wood members have been proposed. For example, U.S. Pat. No. 1,876 336—McLaughlin discloses a sheet metal corner plate attached to a leg by a series of bolts and to side supports by screws. The horizontal planar surface is in turn secured to the side supports by screws. The plate height is equal or less than the height of the side supports such that the corner plate is substantially concealed. The use of screws to attach the side rails and the horizontal planar surface produces a connection that can work loose over a relatively short time. Although the plate is concealed behind the side supports, its height is thereby limited, which reduces the structural moment resistance against deflection of the joint due to forces applied at the opposite end of the leg. It would be desirable to enable attachment of a triangular bracing structure at a point spaced from the joint between the leg and the horizontal surface, without producing aesthetic and structural drawbacks.

U.S. Pat. No. 5,163,373 to Anderson et al. (1992) discloses an elongated metal leg construction adapted to receive a decorative wood cover piece and a metal top plate for connection to the underside of the horizontal planar surface. Reliance on screws to attach the side rails to the horizontal planar surface and the metal top plate to the horizontal planar surface likewise produces a connection that can work loose at the connection points. The large number of pieces and the attention required for the various connections produces a relatively expensive leg construction. Furthermore, the metal gusset plates used to stabilize the leg portion are concealed behind the side supports therefore are of limited height and limited structural moment resistance. Each top plate and leg construction resists the structural moment forces applied along its respective leg independently of the other legs. As a result, extreme pressure can be applied to the screw connections, which are prone to loosen, requiring repair or replacement.

Metal leg members attached by metal fasteners (e.g., screws) to the legs and to the underside of the table top, although usually hidden, can be lengthened such that the diagonal stabilizing members attach lower on each leg and are visible. This improves structural rigidity by reliance on triangulation at the corners. The three members of a triangle are provided by the table top, a diagonal supporting brace (or two braces in perpendicular planes), and an upper portion of the leg between its end attached to the table top and a point of attachment to the brace. The traditional side supports can be eliminated. Various details for the brace and the leg are possible in an effort to create a contemporary aesthetic look. However, in each case the leg extends upwardly to an attachment to the underside of the horizontal planar surface for achieving triangular bracing, and the bracing structure and any fasteners and fittings, are difficult to resolve aesthetically with the table structure. The bracings of fasteners are often therefore aesthetically distinct from the basic table structure and are prominent elements of the appearance of the article of furniture. It would be desirable to merge more effectively the aesthetics of the table and the bracing structures employed.

Bracing designs and fasteners also often involve an excessive number of parts and/or manufacturing operations for assembling parts. Several types of metal fasteners with metal legs have been proposed. U.S. Pat. Nos. 2,822,228—Comer; U.S. Pat. No. 3,366,357—Rudow; and U.S. Pat. No. 3,816,269—Lang disclose examples of techniques attempted for reducing the expense or improving the aesthetics of a fastener and bracing means extending a structurally sufficient distance down the legs. However, there are several problems. The fasteners are connected to the horizontal planar surface with screws that define bracing attachment points that are critical and may weaken with repeated movement. The connection spaced from the top end of the leg provides bracing triangulation for structural stability but the spacing is minimal, which limits such stability. The connection at the leg also defines a critical attachment point that may weaken. There are minimal or no intermediate supports which could distribute the structural moment forces generally among the legs, braces and fasteners.

SUMMARY OF THE INVENTION

It is an object of the present invention to provide a different and better way to resolve conflicting requirements for aesthetics, economy and structural strength, in an article of furniture having a planar member supported on three or more legs.

The bracing fastener of the invention can be produced by economical manufacturing processes, and is attached with strong bolt and/or thread or socket connections to minimize reliance on critical point fasteners such as screws.

According to another aspect of the invention, intermediate side supports connect bracing that distributes deflection forces among a plurality of support members.

These objects are accomplished using a bracing and fastening structure having a simple and distinct aesthetic appearance, using a minimum of parts. However, the configuration is inherently rigid and can be dimensioned to encompass a substantial triangular bracing length, sufficient to virtually eliminate wobbling movement due to structural moment forces. The bracing and fastening elements connect to the legs and to one another below the horizontal surface and at a point on the legs that is substantially below the horizontal surface, which separates each bracing structure into members creating air space around the support members. The result is a strong comer triangulation while breaking open the appearance of the article of furniture at the legs and comers.

These objects are achieved while facilitating assembly and disassembly, and using minimal parts, by relying on a comer fitting element with integrally coupled attachments for the leg, the planar surface and the intermediate supports.

Further objects and advantages of the invention will become apparent from a consideration of the ensuing descriptions and drawings representing exemplary embodiments of the invention.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
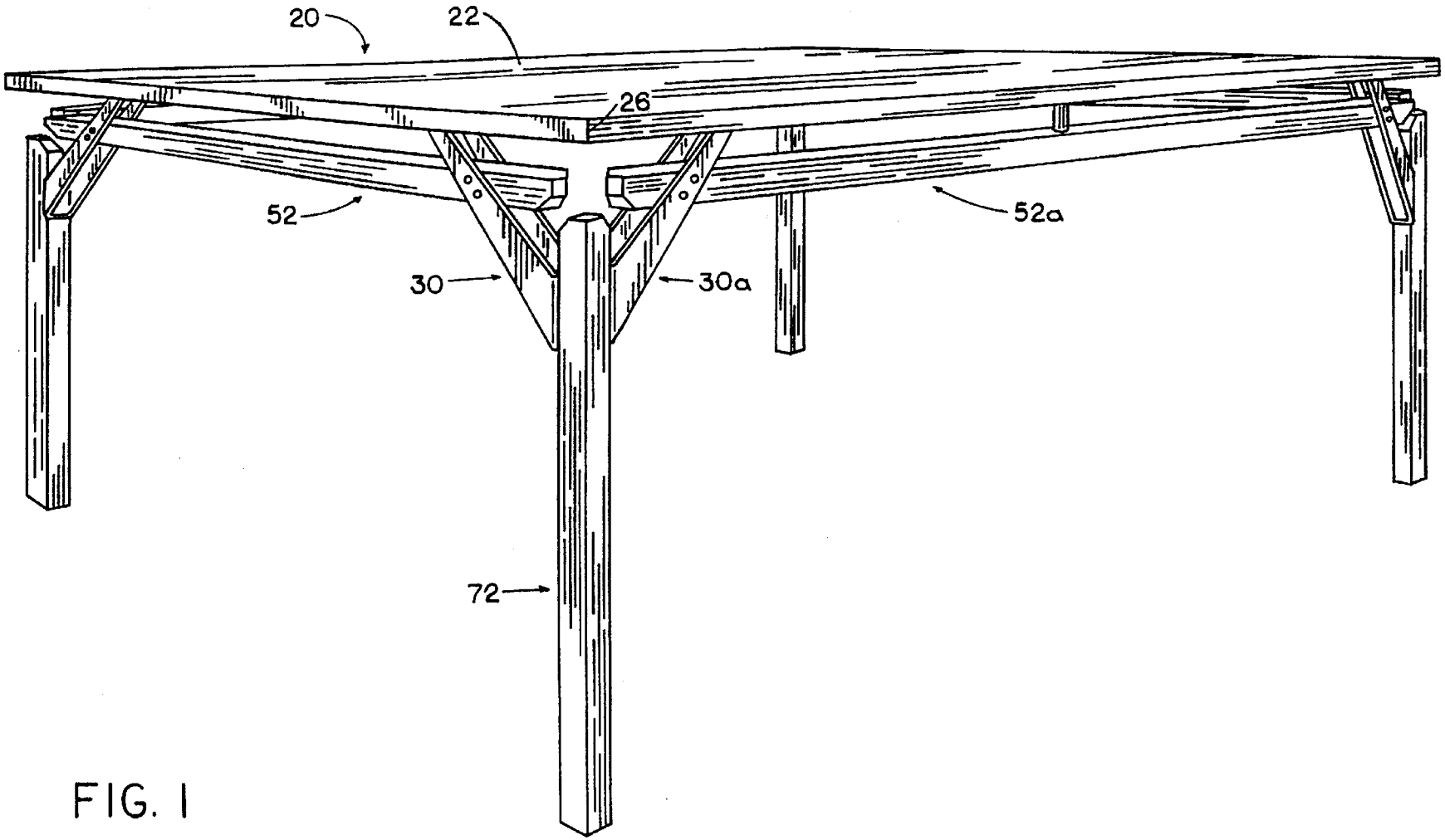
FIG. 1 is a perspective view of a table with buttressed leg joints embodying the novel construction of the invention.
Figure 2:
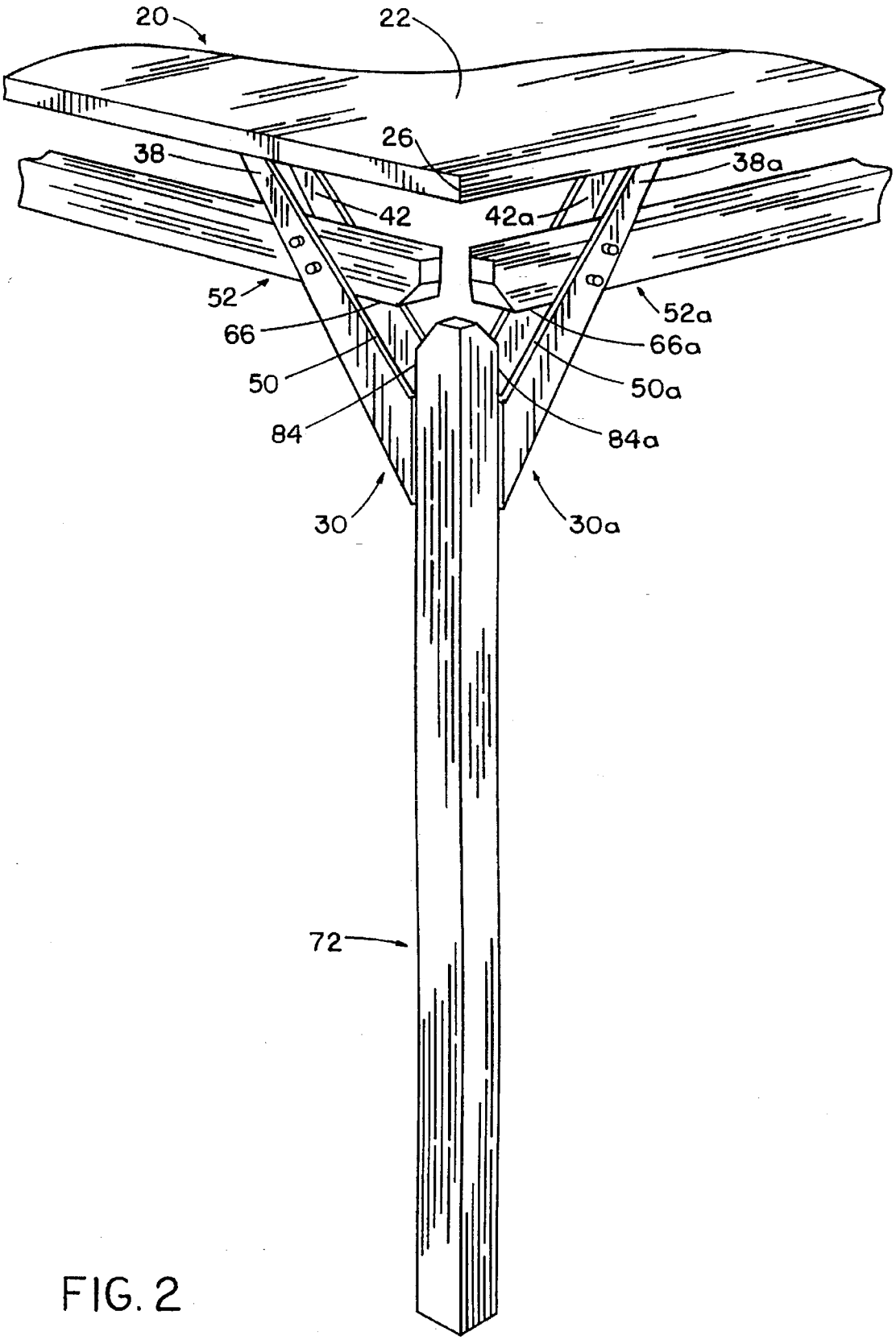
FIG. 2 is an enlarged view of the structure at a corner of the article of furniture shown in FIG. 1, the view being taken from outside the boundaries of the table looking at the corner toward the fastening structure.

According to the invention and as shown generally in FIGS. 1 and 2, an article of furniture 20 has an elongated leg or support 72, for example square in cross section, which is coupled to the underside of a horizontal planar support 22. Support 22 can be a table top, desk top, counter top or the like, or can comprise a cabinet or other item to be supported on legs. Leg 72 has side surfaces 76, 82, each having a novel fastener arrangement 30 attached thereto. Preferably, two fasteners 30, **30*a* are provided, in planes that include leg 72 and are angularly spaced from one another, e.g., perpendicular to correspond to the edges of support 22 as shown. Fastener 30, 30*a* extends diagonally upward from side surfaces 76, 82 of leg 72 to an attachment on the underside of planar support 22, and is attached between its ends to intermediate side supports 52, 52*a*. The top surface of horizontal planar support 22** is shown as flat in the manner of a simple table, but can comprise other structures as well.

Figure 3:
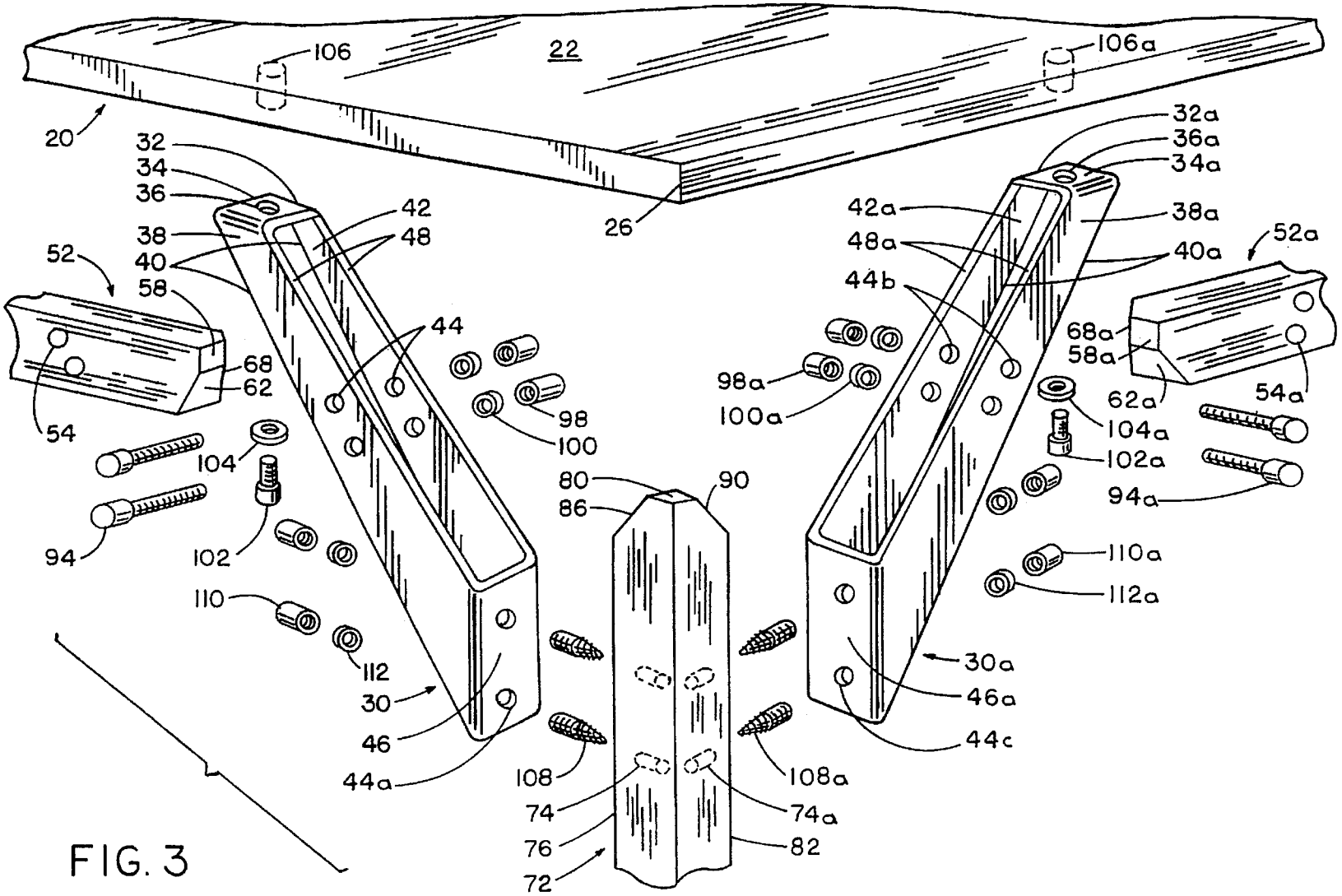
FIG. 3 is an exploded view corresponding to the embodiment of FIG. 2.

Referring to FIG. 3, fasteners 30, **30*a* are metal and each includes a generally rectangular and vertical end plate 46, 46*a*, attachable to leg 72. Elongated side plates 38, 38*a*, 42, 42*a* are integral with the end plates and are disposed at approximately right angles to end plate 46, 46*a* and at angles corresponding to the side surfaces 76, 82 of leg 72. Elongated side plates 38, 38*a*, 42, 42*a* extend upward, parallel to each other, at a given configuration 40, 40*a*, 48, 48*a*. Elongated side plate 38, 38*a* are also integral with and disposed at approximately right angles to a generally square and horizontal end plate 34, 34*a*, that is attachable to the underside of horizontal planar member 22. The end and side plates can be formed from flat stock and attached by weldments 32, 32*a*, such that the opposite end plates are rigidly spaced and disposed at approximately right angles for forming a triangular brace between leg 72 and planar member 22**.

Referring to FIG. 3, the lower end plate 46, **46*a* of fastener 30, 30*a* has means for attachment to leg 72, at a distance below planar member 22, for example holes 44*a*, 44*c* for receiving fasteners. Sides 76, 82 of leg 72** have holes 74, 74*a* at the corresponding position below planar member 22, in this case below the top surface of leg 72, which according to the invention is not attached directly to the underside of planar member 22. Holes 44*a*, 44*c* of end plate 46, 46*a* align with holes 74, 74*a* of leg 72 sides 76, 82. Holes 74, 74*a* are spaced well below top surface 80 of leg 72, which places end plate 46, 46*a* substantially below the bottom surfaces of the intermediate side supports 52, 52*a* extending between the fasteners 30, 30*a* of two spaced legs. Preferably side supports 52, 52*a* extend parallel to the edges of planar support 22, however the legs and intermediate side support members can be spaced inwardly from the edges as well. The legs, intermediate support members and fasteners form a generally triangular open space and provide a form of diagonal bracing between and among the legs and planar support 22.

Referring to FIG. 2, the triangular open space comprises a first side 66, 66*a*, a second side 84, 84*a*and a hypotenuse 50, 50*a*. Referring to FIG. 3, sides 76, 82 of legs 72 receive threaded shafts 108, 108*a* via holes 74, 74*a*. Shafts 108, 108*a* can have wood engaging threads for engaging with leg 72, and machine threads protruding from leg 72. End plates 46, 46*a* fit over threaded shafts 108, 108*a* and abut sides 76, 82 of leg 72. Threaded shafts 108, 108*a* are long enough to extend beyond the inside face of vertical plate 46, 46*a* for receiving washers 112, 112*a* and nuts 110, 110*a* that rigidly secure end plates 46, 46*a* to leg 72.

Referring to FIG. 3, elongated side plates 38, 38*a*, 42, 42*a* of fastener 30, 30*a* have holes 44, 44*b* between the opposite ends of fastener 30, 30*a*, for example somewhat above a midpoint but sufficient to carry intermediate side supports at a distance from the underside of planar support 22. Holes 44, 44*b* are aligned horizontally to match corresponding holes 54, 54*a* in intermediate side supports 52, 52*a*. Bolts 94, 94*a* secure intermediate side supports 52, 52*a* to elongated side plates 38, 38*a* 42, 42*a*, including washers 100, 100*a* and nuts 98, 98*a*.

The bottom surface of horizontal support 22 is adapted to receive a threaded inlet fitting 106, 106*a*, which preferably does not extend through to the top surface of planar support 22. Inlet fitting 106, 106*a* can have internal female threads for receiving a bolt and external male threads for engaging support 22. Fitting 106, 106*a* fixes the upper end of fastener 30, 30*a* rigidly at a given distance from corner 26 and the sides of planar support 22, where end plate 34, 34*a* of fastener 30, 30*a* is secured to the bottom surface of horizontal support 22 by a bolt 102, 102*a* through a washer 104, 104*a* and a hole 36, 36*a* in end plate 34, 34*a*. Bolt 102, 102*a* is threaded into inlet 106, 106*a*, providing a rigid attachment.

Side supports 52, 52*a* are cantilevered and extend beyond elongated side plates 38, 38*a*, 42, 42*a* toward leg 72. Leg 72 extends upward beyond vertical plate 46, 46*a* toward the ends of intermediate side supports 52, 52*a*. Side supports 52, 52*a* and leg 72 can be mitered at their ends, suggesting a joint, but preferably are spaced from one another at two angled end surfaces 62, 62*a*, 68, 68*a* and 86, 90 respectively. The point resulting from mitering is eliminated at the ends, creating generally square end surfaces 58, 58*a* and 80, which are perpendicular to side supports 52, 52*a* and to leg 72. Angled end surfaces 62, 62*a*, 68, 68*a* and 86, 90 are spaced from each other by a given distance, creating spaces between the structural members, which are operatively connected to one another and to planar support 22 by triangular bracing fasteners 30, 30*a*.

Where side supports 52, 52*a* are relatively long, it is also possible to insert a spacer between side supports 52 or 52*a* and the underside of planar support 22, as shown in FIG. 1 at the midpoint between adjacent legs 72. This increases the rigidity of planar support 22, provided the side supports are rigid members. The spacer can be fastened by a bolt (not shown) extending through the spacer and through side support 52 or 52*a*, into planar support 22.

The structure for attaching the legs and the planar support as described provides a form of triangular bracing, but not the conventional form wherein the triangles include the upper end of the leg. Triangular bracing of rigid members is known to provide a rigid structure even where the junctions between the members are simply bolted or pinned. The placement and configuration of fastener 30, 30*a* at each comer creates a generally triangular shape that leans inwardly from comer 26. The triangular shape has an apex substantially below the horizontal planar support 22 at leg 72. The sides of the triangle are created by elongated side plates 38, 38*a*, 42, 42*a*, with apices at inlet fittings 106, 106*a*. The hypotenuse is created between end plates 34, 34*a*, namely between inlet fittings 106, 106*a*, within the structure of horizontal planar support 22.

In the embodiment shown, the side plates 38, 38*a*, 42, 42*a* of connection pieces 30, 30*a* are substantially linear members disposed at an angle of about 45° relative to the plane of planar support 22. It is also possible to provide curved or otherwise configured members, provided rigid support is provided between the ends of these members coupled respectively to the planar support and to the leg. Whereas the leg does not extend to a direct connection at the comer of planar support 22, the configuration does not form two triangular braces in perpendicular planes, as is characteristic of conventional bracing. Instead, there is one bracing triangle that leans upwardly and inwardly of article 20 at each leg. Assuming that the connection pieces 30, 30*a* are at 45° in the planes of the edges of support 22, the plane of the leaning bracing triangle is inclined at 60° to the plane of planar support 22. Other specific angles are also possible, the angles shown being merely examples.

The triangular bracing provided as above would appear to be rigid against deflection of leg 72 in a direction parallel to the plane of the triangle, but to permit deflection in a direction perpendicular to the plane of the triangle, namely diagonally inwardly or outwardly along comer 26 of planar support 22. However, additional support is provided by intermediate side supports 52, 52*a*, attached at a distance below the apex at inlet fittings 106, 106*a*. In the embodiment shown, side supports 52, 52*a* are attached to fasteners 30, 30*a* at approximately the mid point of the triangle sides. This intermediate support distributes structural forces perpendicular to the plane of the triangle to other legs and associated fasteners.

Cooperation among a plurality of side supports 52, 52*a*, fasteners 30, 30*a* and horizontal planar support 22 is thereby achieved. Strain is relieved on the attachment of any given fastener to the horizontal planar support 22 only or on the attachment of a fastener to a side supports 52, 52*a* only. This has been found substantially to eliminate the need to extend leg 72 up to a direct attachment to horizontal planar support 22 to improve rigidity. Likewise, the structure is sufficiently rigid without the need to abut side supports 52, 52*a* endwise against leg 72 or laterally against horizontal planar support 22, or to wrap fastener 30, 30*a* around the comer immediately below horizontal planar support 22. Such connections are possible if additional structural integrity is needed, but the invention as shown has been found substantially rigid and durable in connection with the typical structural needs of most tables and the like. Moreover, the invention provides a structure including comer 26 and the various members, which is open substantially below horizontal planar support 22, and thus has substantial aesthetic appeal.

Fastener 30, 30*a* can be manufactured economically by die cutting. A piece of sheet metal is cut, drilled, bent and welded into the configuration illustrated in FIGS. 1 to 3. A suitable finish can be applied to the metal. The legs, side supports and horizontal planar support preferably are wooden, cut into the configurations illustrated in FIG. 3. A suitable finish is likewise applied to the wood. Fasteners 30, 30*a* are disposed at approximately right angles to one another at each leg 72, and rigidly attached.

Fastener 30, 30*a*, preferably of metal, includes a generally rectangular and vertical end plate 46, 46*a*, which preferably has a width approximately equal to that of side 76, 82 of leg 72. End plates 46, 46*a* have a height to extend along a portion of leg 72 sufficient for two spaced fastening bolts, providing substantial rigidity. Attachment of end plate 46, 46*a* to leg 72 sides 76, 82 forms on apex of the triangle described above. Elongated side plates 38, 38*a*, 42, 42*a* are integral and disposed at approximately right angles to end plate 46, 46*a*. Elongated side plates 38, 38*a*, 42, 42*a* extend upward, parallel to each other, at a given configuration 40, 40*a*, 48, 48*a*. Elongated side plates 38, 38*a*, 42, 42*a* form the sides of the triangle. Elongated side plates 38, 38*a*, 42, 42*a* straddle and engage side supports 52, 52*a* in tension and compression, and are of sufficient depth to resist rotation of side supports' 52, 52*a*. Elongated side plates 38, 38*a* are each integral and disposed at approximately a right angle to a generally square and horizontal end plate 34, 34*a*. Elongated side plate 42, 42*a* is secured by weldments 32, 32*a* and disposed at approximately a right angle to end plate 34, 34*a*. Attachment of end plate 34, 34*a* to the bottom surface of horizontal planar support 22 provides the end points to the hypotenuse of a rigid triangle as described. Closure of fastener 30, 30*a* unifies the plates 34, 34*a*, 38, 38*a* 42, 42*a*, 46, 46*a* into a rigid integral unit. This unit provides substantially rigid connections to support members.

The side support members as shown encompass the legs in a closed configuration, i.e., the side support members and the bracing members of the joints to which they are attached form a closed geometric form (in this case a rectangle). It would be possible to arrange the legs in other numbers of legs, namely three or more, to likewise form a structure in which the tendency of the bracing means of any particular leg to divert due to vertical or lateral forces on the table or the like, are distributed to all the legs in the closed configuration. It is also possible that two or more such closed configurations can be disposed inside one another.

Figure 4:
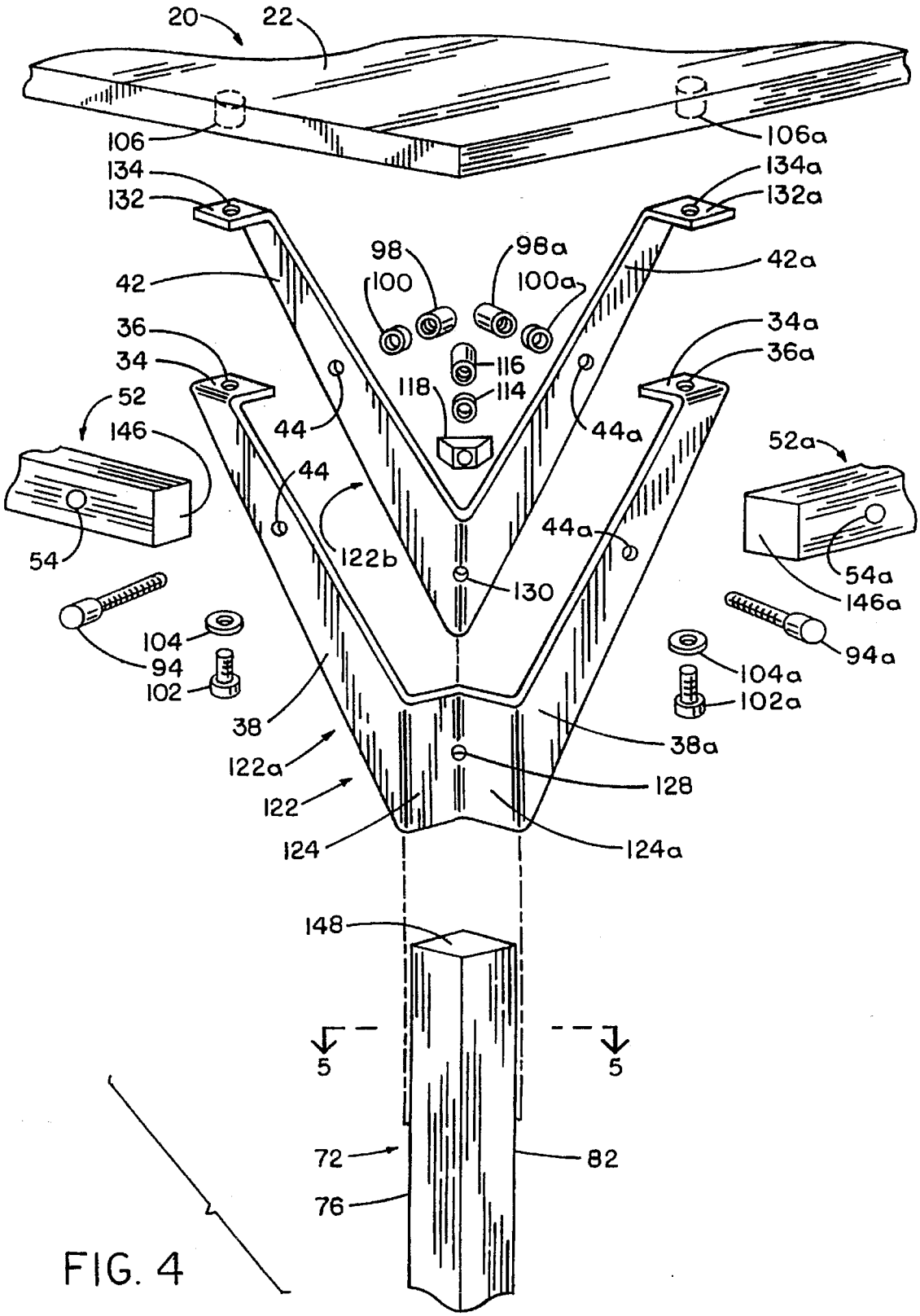
FIG. 4 is an exploded view illustrating an alternative embodiment.
Figure 5:
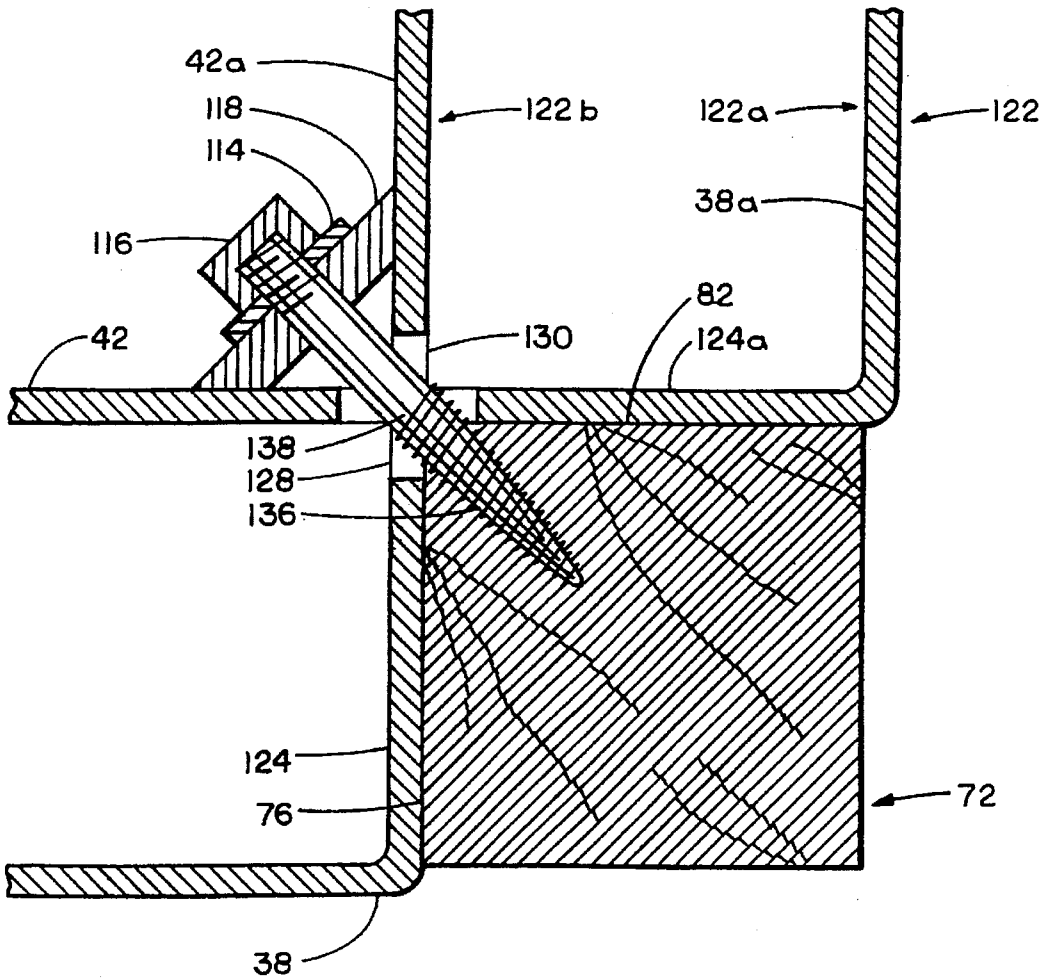
FIG. 5 is a section through the leg attachment of FIG. 4.

FIGS. 4 and 5 illustrate an alternative embodiment wherein the plates defining the triangular legs have a somewhat different configuration but make the same structural connections discussed above. The same reference numbers are used in the respective embodiments where possible to identify corresponding elements. A metal fastener 122 includes two pieces 122*a*, 122*b*. In this embodiment the bracing elements of the fastener are each V-shaped and connected to the planar support 22 at the ends of the V-shape and to the upper end of the leg at the bottom of the V-shape. The first piece 122*a* consists of end plates 124, 124*a* which are integral and disposed at slightly less than a right angle to one another and at approximately a right angle to elongated side plates 38, 38*a*. The second piece 122*b* includes side plates 42, 42*a* which are integral to and disposed at approximately a right angle to one another and to horizontal end plates 132, 132*a*. End plates 132, 132*a* align and abut end plates 34, 34*a* of the first piece.

End plates 124, 124*a* have a hole 128, at their juncture, approximately centered vertically. Elongated side plates 42, 42*a* have a hole 130, at their juncture, approximately centered vertically. Hole 128 aligns with hole 130 and admits a fastener for attaching the two pieces at or adjacent to a top 148 of leg 72. As shown in FIG. 5, sides 76, 82 of leg 72 have a hole 136 at their juncture, at a space below top surface 148. A threaded shaft 138 is inserted and secured in hole 136 for engaging end plates 124, 124*a* via hole 128, that slides over threaded shaft 138 until the plates abut sides 76, 82 of leg 72. Side plates 42, 42*a* have hole 130 to slide over threaded shaft 138 for abutting the end plates 124, 124*a*. Threaded shaft 138 extends beyond the inside face of the juncture of side supports 42, 42*a*, and through a metal spacer 118, a washer 114 and a nut 116 for securing end plates 124, 124*a* and elongated side plates 42, 42*a* to leg 72. The spacer 118 provides a flat surface for seating the washer and nut. The V-shaped members straddle the side support members 52, 52*a*, providing a structural connection similar to that of the foregoing embodiment.

End plate 132, 132*a* has a hole 134, 134*a* which aligns with hole 36, 36*a* of end plate 34, 34*a* for securing the second piece 122*b* of fastener 122 to bottom surface of horizontal support 22. Leg 72 and side supports 52, 52*a* terminate at generally square and perpendicular end surfaces 148, 146, 146*a*, respectively.

The fastener arrangement shown in FIGS. 4 and 5 provides similar structural advantages to the embodiment of FIGS. 1–3, but has fewer parts. The two pieces 122*a*, 122*b* integrate the end plates 124, 124*a* and elongated side plates 42, 42*a* around the inside corner of leg 72, which attach rigidly to the three apices as above. This embodiment eliminates a plurality of bolts at leg 72 and end plates 124, 124*a*, reducing labor costs for the production of fastener 122 and leg 72. End plates 124, 124*a* are slightly less than a right angle to each other so when secured to leg 72 rotation is substantially eliminated by a locking-in effect. This integration of the main components around corner 26 of horizontal planar support 22 is economical and provides structural unity between both sides of each corner of the article of furniture 20.

Figure 6:
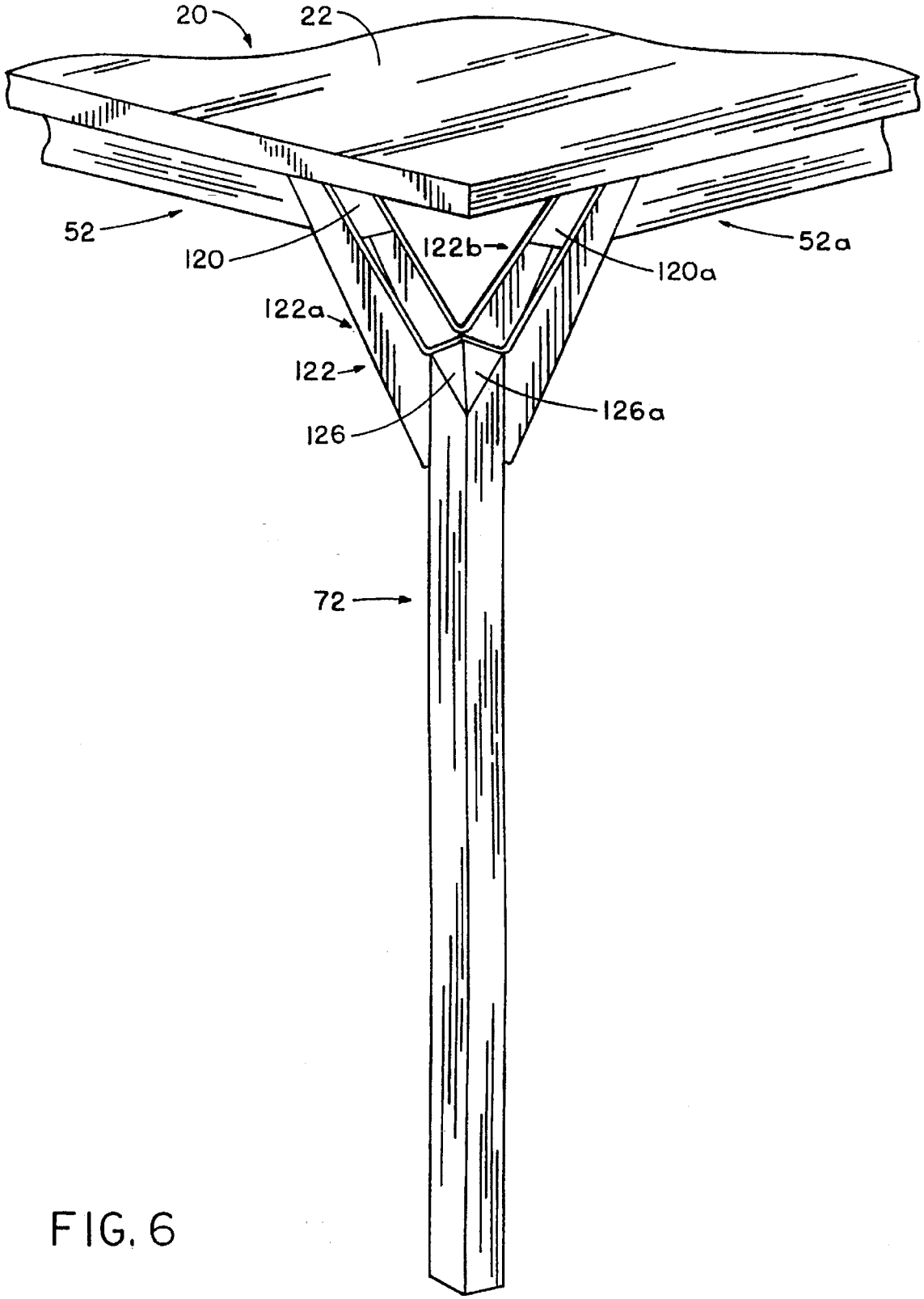
FIG. 6 is an enlarged view of a corner showing third embodiment.
Figure 7:
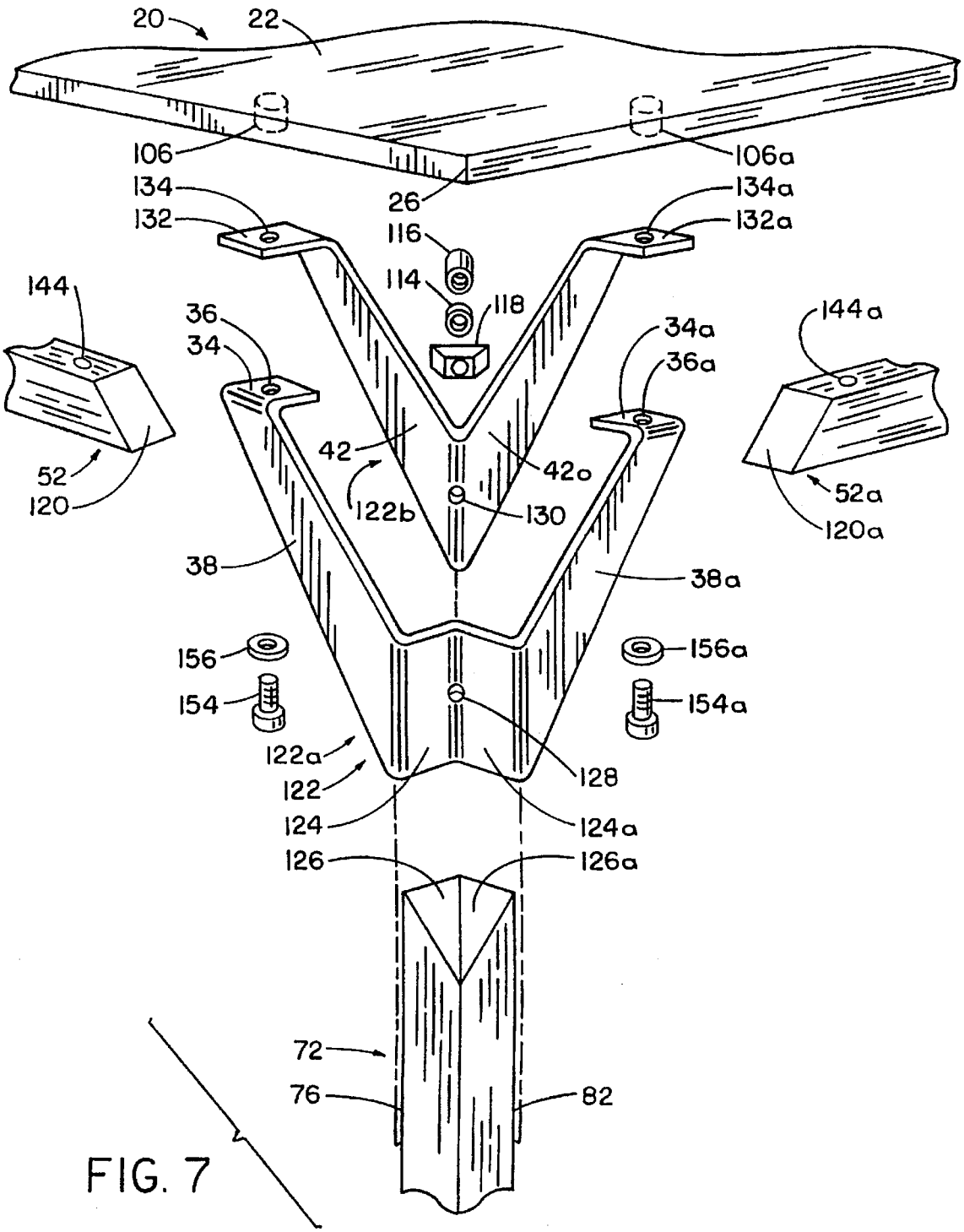
FIG. 7 is an exploded view of the embodiment of FIG. 6.

FIGS. 6 and 7 depict a further alternative embodiment. A metal fastener 122 in this case is similar to the fastener in FIG. 4. The portions of side plates 38, 38*a*, 42, 42*a* above side supports 52, 52*a*, however, are omitted, and end plates 34, 34*a*, 132, 132*a* abut one another. The top surface of side supports 52, 52*a* abuts end plates 34, 34*a*. The bottom surface of horizontal support 22 abuts end plates 132, 132*a*.

End plates 34, 34*a*, 132, 132*a* holes 36, 36*a*, 134, 134*a* align with a hole 144, 144*a* in side support 52, 52*a*. Hole 144, 144*a* extends from the bottom surface of side support 52, 52*a* through to the top surface. Side support 52, 52*a* is secured to fastener 122 and horizontal support 22 by inserting a bolt 154, 154*a* up through a washer 156, 156*a*, hole 144, 144*a*, holes 36, 36*a*, 134, 134*a*, and threaded into threaded inlet 106, 106*a*. This arrangement places the side supports nearly directly against the underside of the planar top, presenting a more traditional appearance resembling side rails.

The ends of side supports 52, 52*a* each form a generally rectangular end surface 120, 120*a* at an angle relative to side plates 38, 38*a*, 42, 42*a*. Leg 72 ends with generally triangular end surfaces 126, 126*a* at a given angle to side surfaces 76, 82, which blends the angles of these elements and emphasizes the open space.

Eliminating the portion of elongated side plates 38, 38*a*, 42, 42*a* above side supports 52, 52*a* connects side supports 52, 52*a* to fastener 122 and fastener 122 to horizontal support 22 using the same fasteners, thereby also eliminating holes and additional production steps. The lower portion of the triangle from the intermediate support of side supports 52, 52*a* to leg 72 remains to provide structural integrity, and to an extent, side supports 52, 52*a* in this embodiment also add rigidity to the horizontal planar support 22, but especially to elongated side plates 38, 38*a*, 42, 42*a*.

A further embodiment is shown in FIGS. 8–11. In this case the article of furniture 20 has a leg 160 with a cross section that is generally round. Leg 160 has an integral fastener 158, for example cast, providing socket connections for leg 160 and side supports 164, 164*a*, and flanges 178, 178*a* for attachment to the underside of planar support 22. Fastener 158 extends upward away from leg 160 beyond side support 164, to which it is attached, for example, using a bolt or pin passed laterally through the socket. Fastener 158 continues upward to horizontal support 22, where it is also attached by bolts or the like.

Figure 8:
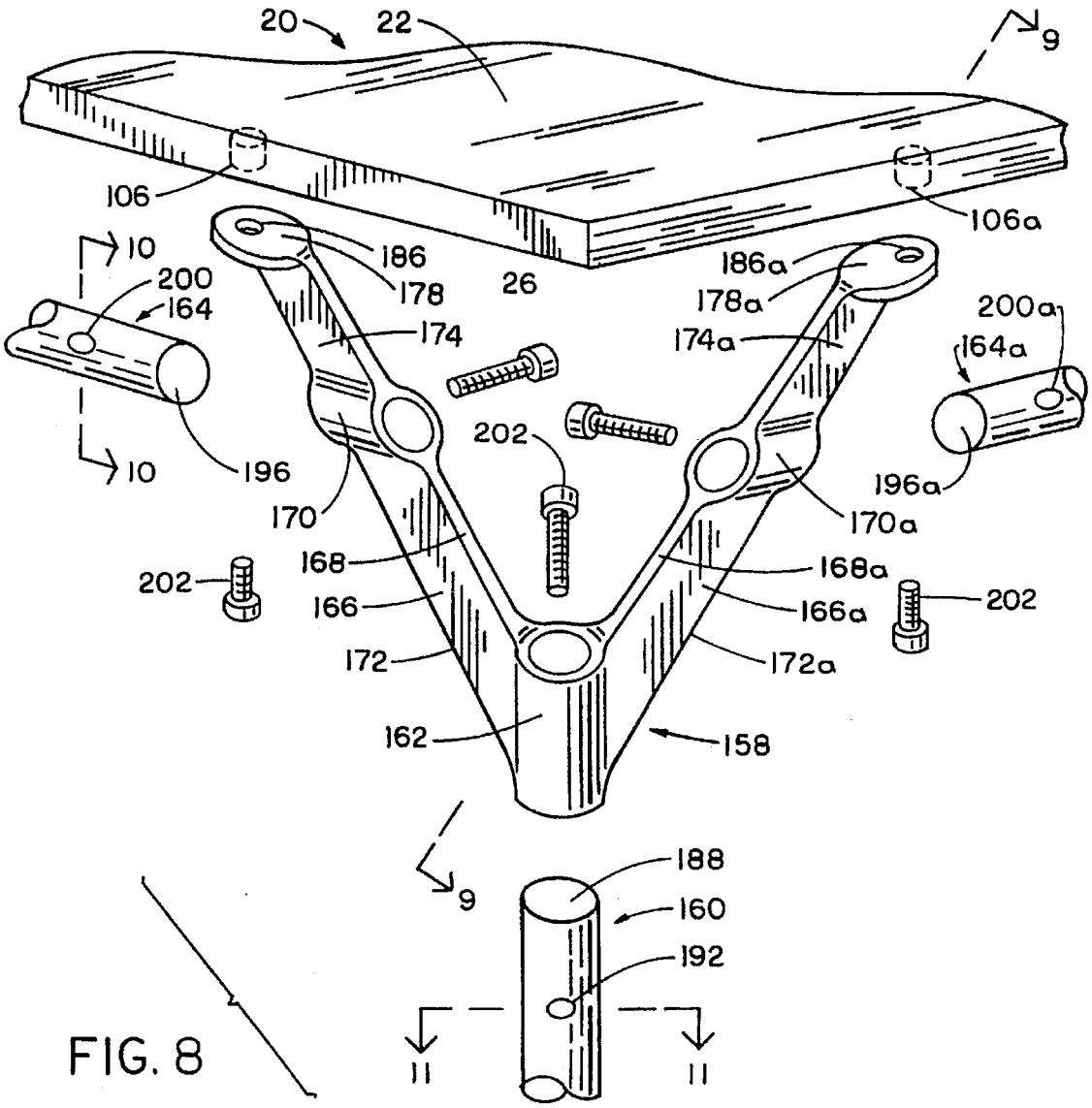
FIG. 8 is an exploded view of a further alternative embodiment.

Referring to FIG. 8, cast metal fastener 158 includes a generally vertical tube 162 complementary with the leg, e.g., cylindrical, but also potentially of another shape. Elongated side plates 166, 166*a* are integral with tube 162 along at least a portion of its height and are disposed at approximately right angles to one another. Side plates 166, 166*a* extend upward away from the socket engaged with the upper end of leg 160, as in the previous embodiments, including via connected members 168, 168*a*, 172, 172*a*. Elongated side plates 166, 166*a* are integrally coupled to the bottom of a generally horizontal cylindrical tube 170, 170*a* (or other shape complementary to the side supports). Tubes 170, 170*a* are disposed at approximately a right angle to one another. Side plates 174, 174*a* are integrally coupled to the top of tube 170, 170*a*. The side plates are coupled to the underside of planar support 22 at integrally connected flanges 178, 178*a*, which in the embodiment shown are circular and receive one bolt or other fastener.

Figure 9:
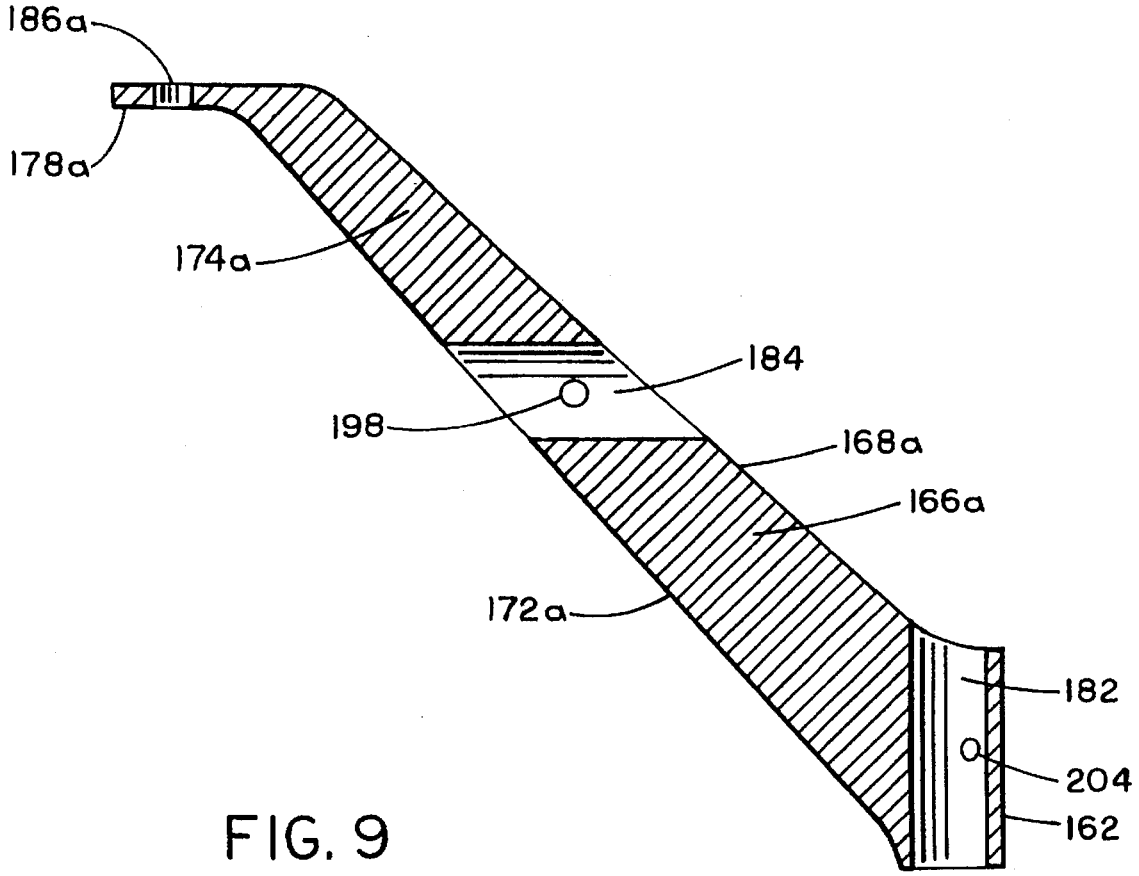
FIG. 9 is a section through the fastener of FIG. 8.
Figure 11:
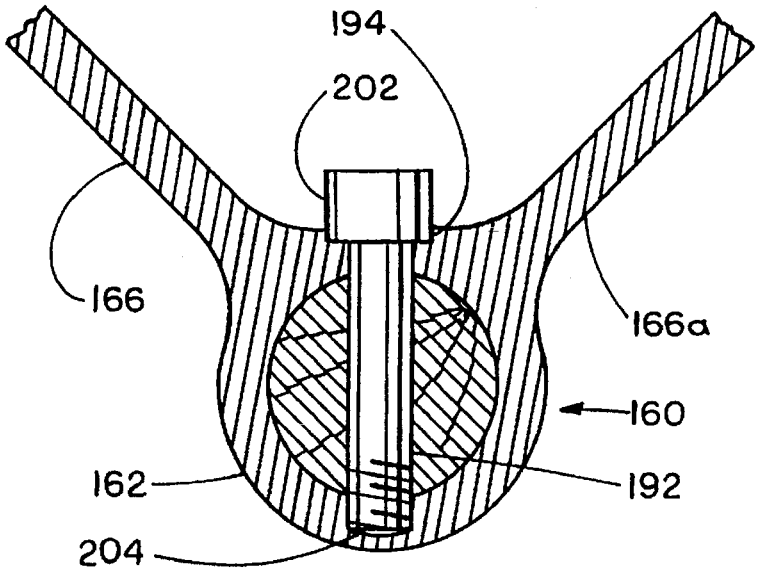
FIG. 11 is a section through the leg support attachment of FIG. 8.

Referring to FIGS. 9 and 11, tube 162 of this embodiment has a countersunk hole 194 on its blind side, approximately centered horizontally and vertically. Leg 160 has a hole 192 spaced down from top surface 188. Leg 160 is inserted up through tube 162 until countersunk hole 194 aligns with hole 192 of leg 160. Leg 160 is secured to tube 162 by inserting a bolt 202 into holes 194, 192 and threading it into a threaded inlet 204 on a tube interior 182 opposite countersunk hole 194, such that the bolt is engaged on both sides of the tube.

The bottom surface of horizontal planar support 22 receives a threaded inlet 106, 106*a* at a space from comer 26. Flanges 178, 178*a* of fastener 158 substantially extend beyond elongated side plates 174, 174*a* to allow for placement of countersunk hole 186, 186*a*. Flanges 178, 178*a* are secured to the bottom surface of horizontal planar support 22 by inserting a bolt 206, 206*a* up through countersunk hole 186, 186*a* and threading bolt 206, 206*a* into threaded inlet 106, 106*a*.

Figure 10:
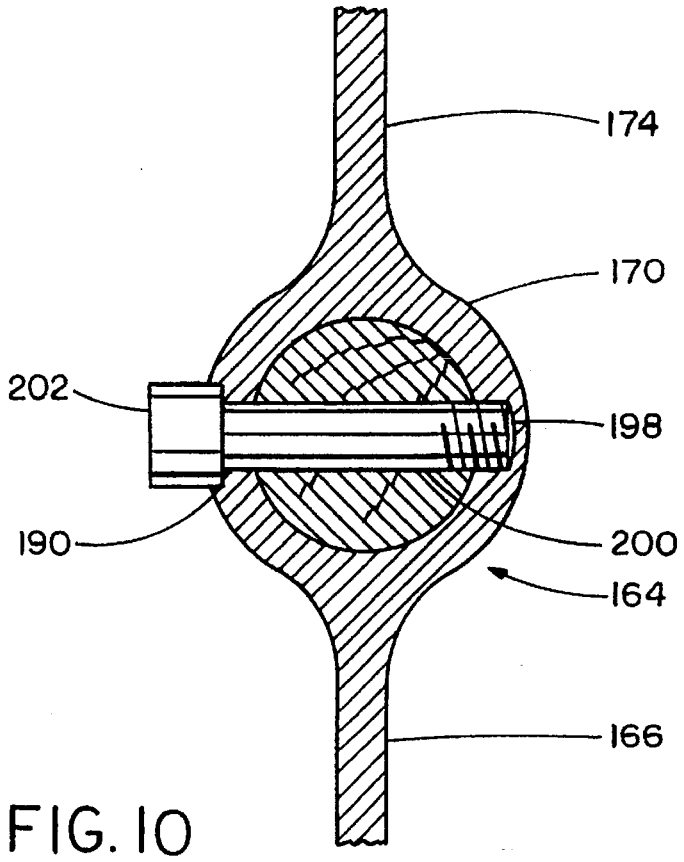
FIG. 10 is a section through the side support attachment shown in FIG. 8.

Referring to FIG. 10, tube 170, 170*a* has a countersunk hole 190 on its blind side, approximately centered horizontally and vertically. Side support 164, 164*a* has a hole 200, 200*a* at a given distance from end surface 196, 196*a*. Side support 164, 164*a* is inserted into tube 170, 170*a* until countersunk hole 190 aligns with hole 200, 200*a* of side support 164, 164*a*, and is secured by inserting bolt 202 into holes 190, 200, 200*a* and threading it into a threaded inlet 198 on the interior of tube 170, 170*a* opposite countersunk hole 190, such that the bolt is engaged on both sides of the tube.

Side supports 164, 164*a* are cantilevered past tube 170, 170*a* toward leg 160. Leg 160 extends upward past tube 162 toward cantilevered side supports 164, 164*a*, as described with reference to the previous embodiment of FIGS. 1–3. Side supports 164, 164*a* and leg 160 end with perpendicular end surfaces 196, 196*a* and 188 respectively. End surfaces 196, 196*a* and 188 are spaced to provide openings between each side support 164, 164*a* and leg 160.

Fastener 158 is economically manufactured, through metal casting, into the configuration illustrated in FIGS. 8–11. A suitable finish is applied. The preferably-wood legs, side supports and horizontal support are cut into the configurations illustrated in FIG. 3, and suitably finished. Fasteners 158 are installed at each leg.

Figure 12:
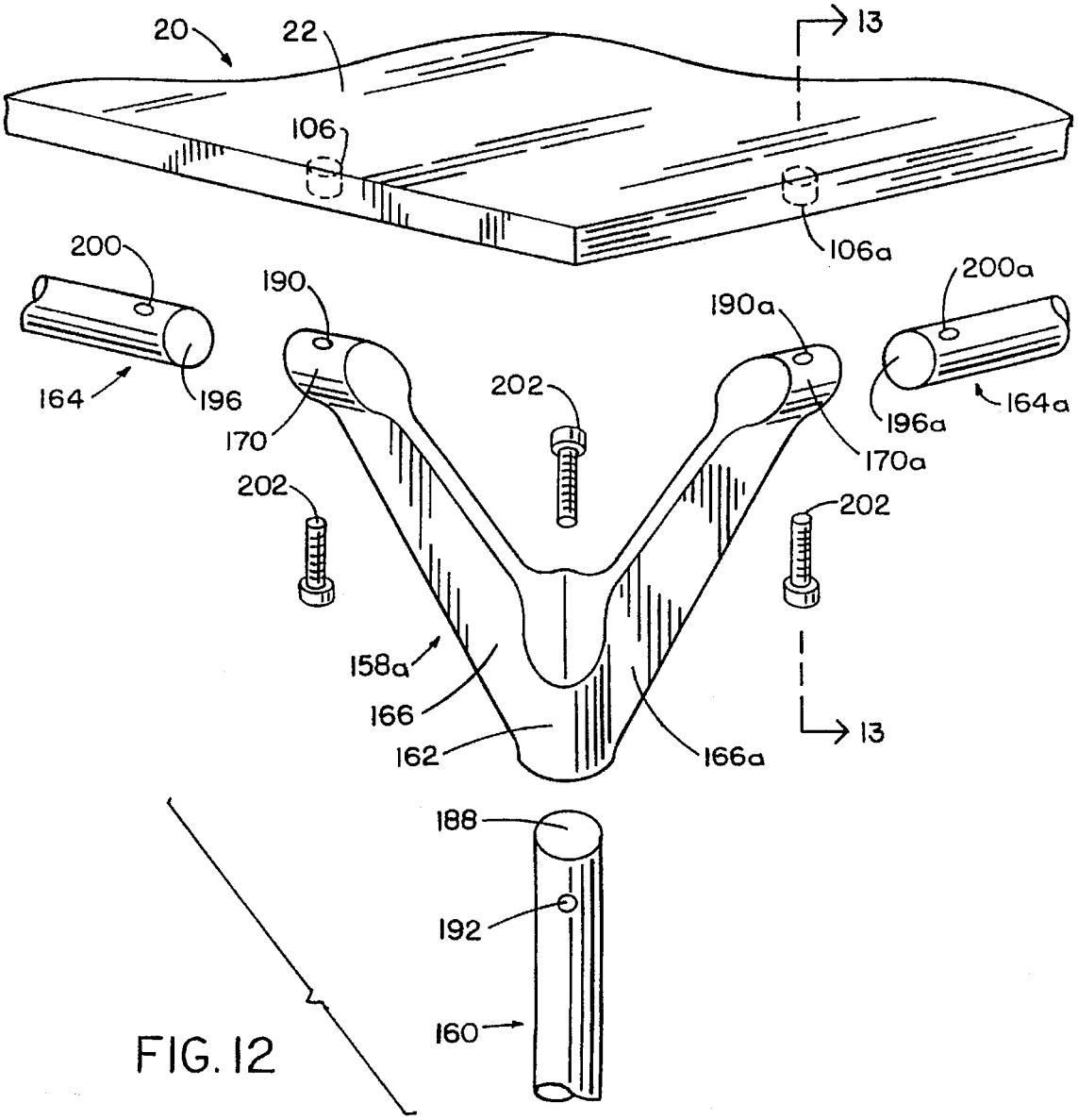
FIG. 12 is an exploded view of a further alternative embodiment.
Figure 13:
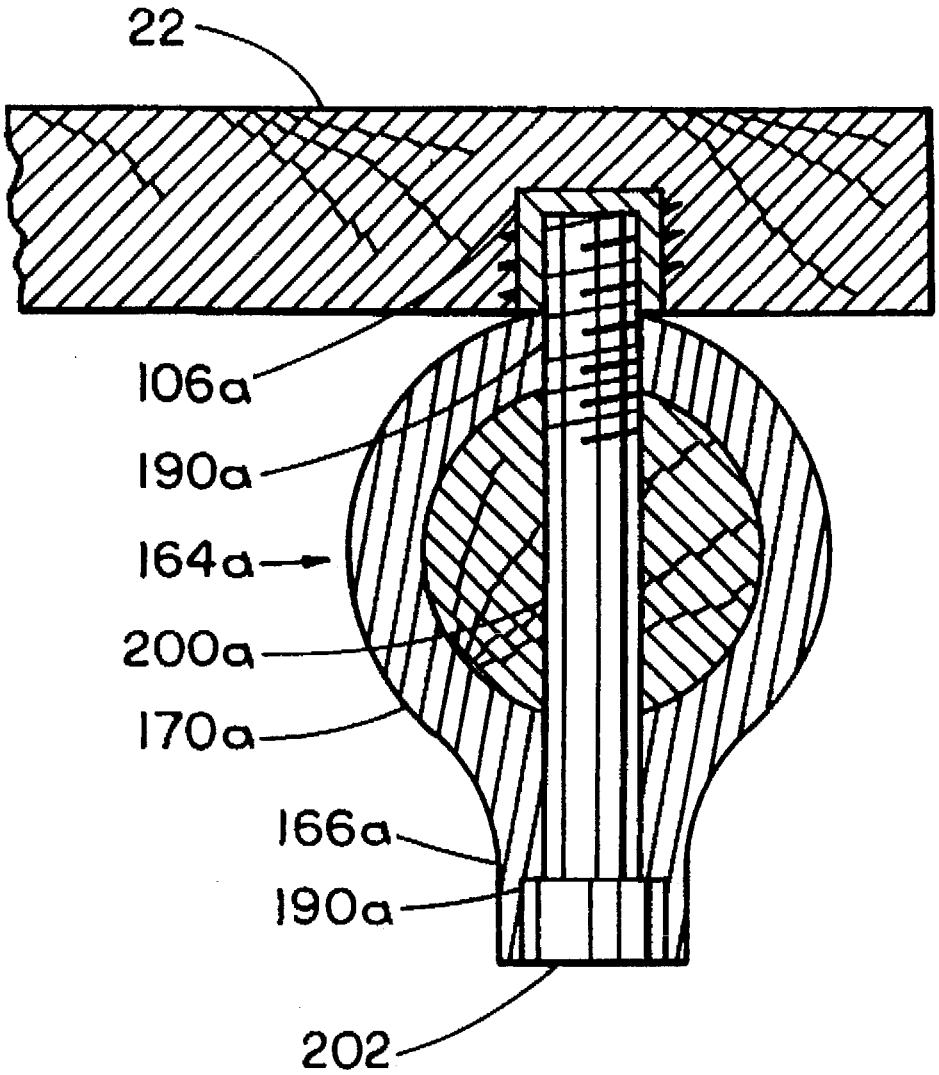
FIG. 13 is a section through the side support and horizontal planar surface attachment of the embodiment of FIG. 12.

The cast metal fastener 158*a* of FIGS. 12 and 13 is similar to fastener 158 of FIGS. 8–11, except elongated side plates 174, 174*a* and flanges 178, 178*a* have been omitted. Bolt 202 is inserted up through a countersunk hole 190, 190*a* in side plates 166, 166*a*, tube 170, 170*a* and through hole 200, 200*a* in side support 164, 164*a*. Bolt 202 is threaded into threaded inlet 106, 106*a* and secured thereto.

Eliminating the upper portion of elongated side plates 174, 174*a* and end plates 178, 178*a* above side supports 164, 164*a* combines connection of side supports 164, 164*a* to fastener 158*a* and fastener 158*a* to horizontal support 22. This eliminates several holes and additional fasteners, and reduces labor costs. The lower portion of the triangle from the intermediate support of side supports 164, 164*a* to leg 72 provides the necessary structural integrity.

The side supports 164, 164*a* have generally round ends 196, 196*a*, the side supports ending at a given space beyond holes 200, 200*a* where, in this embodiment, they are supported by and hidden within tubes 170, 170*a*. Leg 72 likewise has a generally round end surface 188 which ends at a given distance above hole 192 and is supported by and hidden within tube 162. The side supports 164, 164*a* and leg 72 can extend toward one another, but according to the invention they need not be attached to obtain durable rigid joints of the legs and the planar support.

Figure 14:
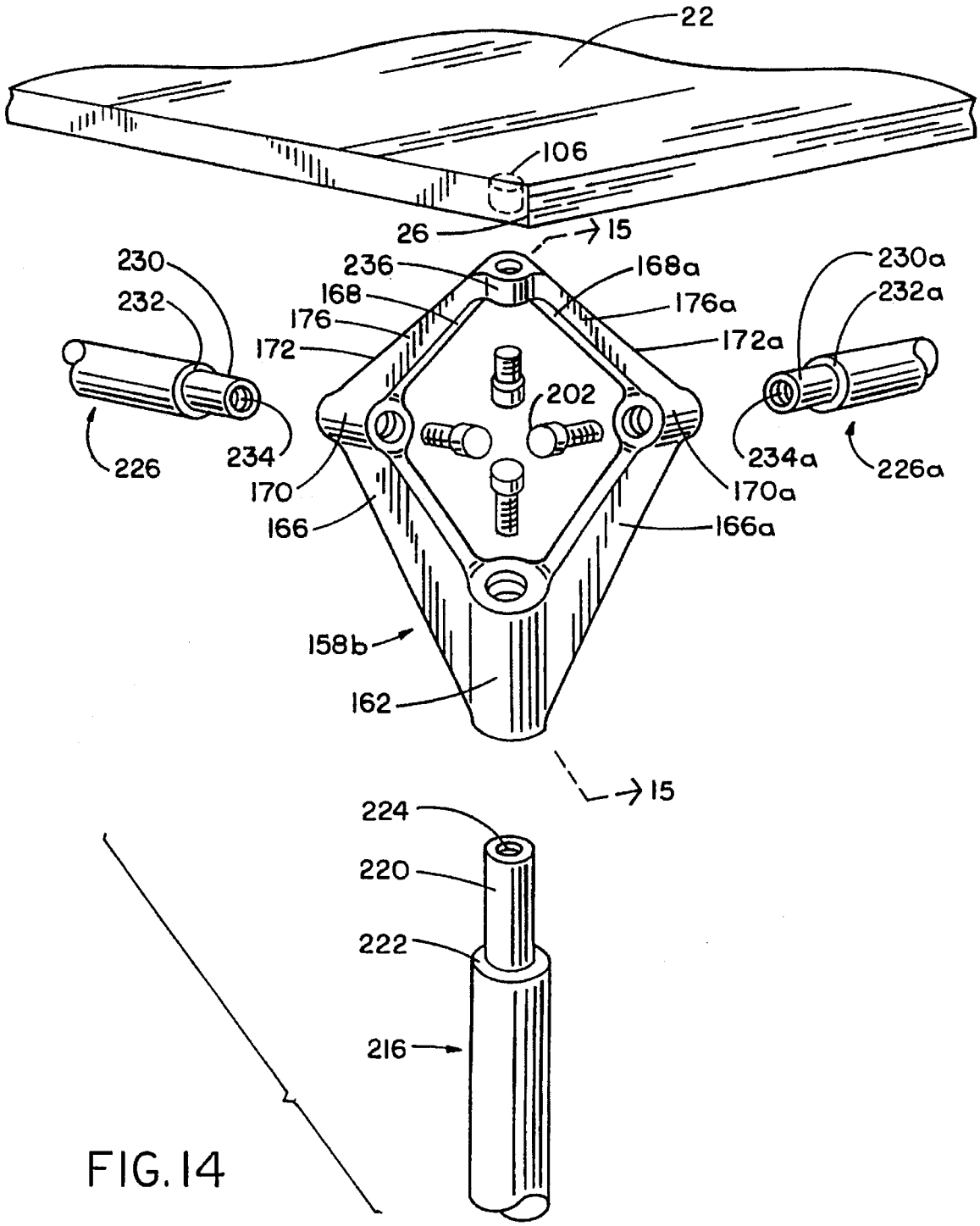
FIG. 14 is an exploded view showing a further alternative embodiment.
Figure 15:
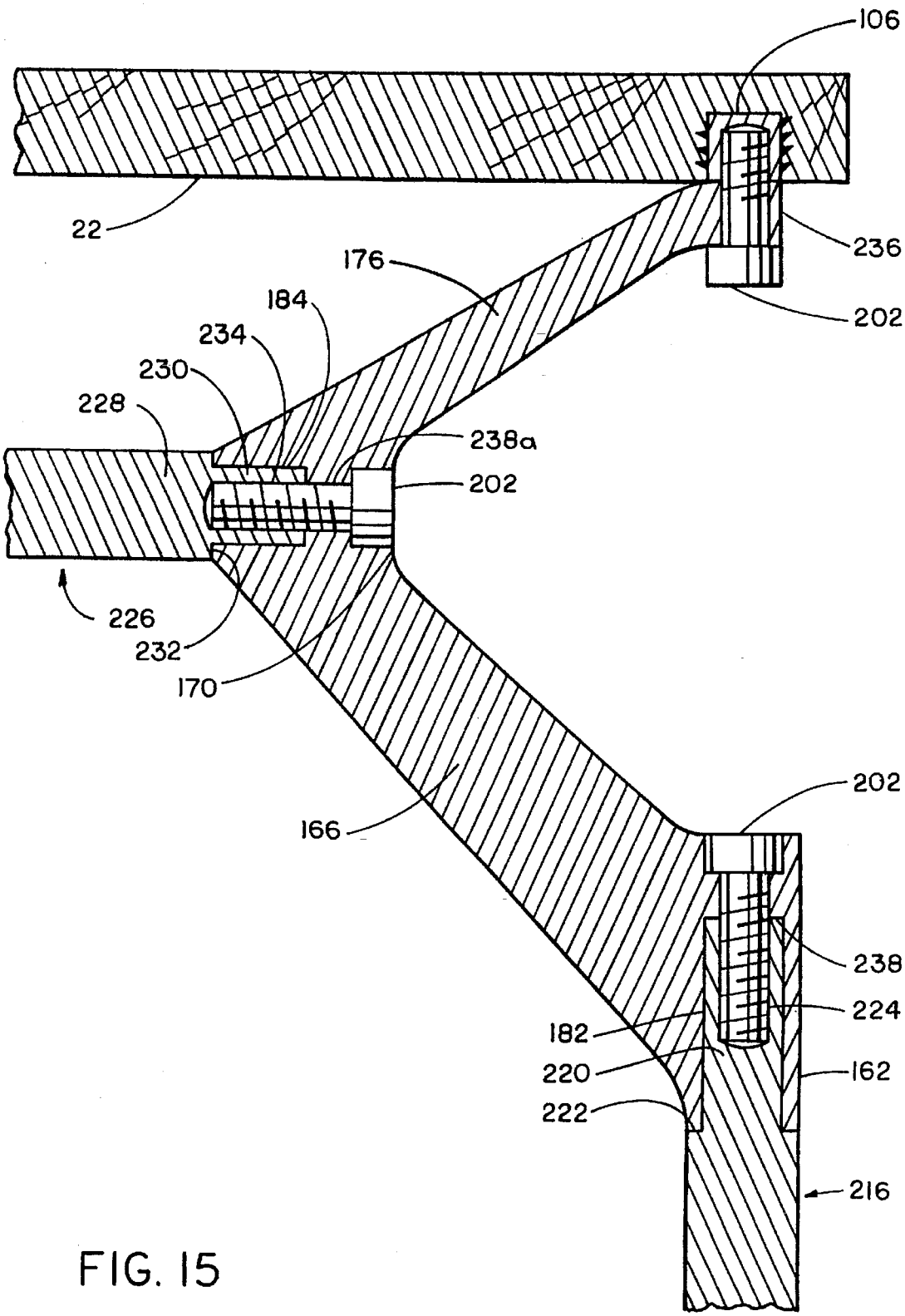
FIG. 15 is a section through the fastener in FIG. 14.

In FIGS. 14 and 15, a cast metal fastener 158*b* is similar to fastener 158 except elongated side plates 176, 176*a* are angled along members 166, 166*a* in a configuration 168, 168*a*, 172, 172*a*, toward comer 26 of horizontal planar surface 22, and the attachments of side supports 226, 226*a* and leg 216 to fastener 158*b* are somewhat different. Elongated side plates 176, 176*a* are integral and disposed at approximately a right angle to a tube 236. Bolt 202 is inserted up through tube 236 and threaded into threaded inlet 106 and attached thereto. Side supports 226, 226*a* end with a slightly smaller end tube 230, 230*a* which creates a generally circular transition plate 232, 232*a*. End tube 230, 230*a* has a threaded inlet 234, 234*a*. Tube 170, 170*a* has a stop 238*a*along a portion of tube interior 184. Side supports are inserted into tubes 170, 170*a* until they abut stop 238*a*. Bolts 202 are inserted into tube 170, 170*a* and threaded into threaded inlet 234, 234*a* until they abut stop 238*a* and are secured thereto. Leg 216 ends with a slightly smaller end tube 220 which creates a generally circular transition plate 222. End tube 220 has a threaded inlet 224. Tube 162 has a stop 238 along a portion of tube interior 182. Leg 216 is inserted into tube 162 until abutting stop 238. Bolt 202 is inserted into tube 162 and threaded into threaded inlet 224 until abutting stop 238 and secured thereto.

Side supports 226, 226*a* and leg 216 having threaded inlets 234, 234*a*, 224 and tubes 170, 170*a*, 162 having a stop 238*a*, 238 bolts 202 are effective to secure all the supporting members to form a substantially rigid frame. In this embodiment, there is only one means of attachment to the horizontal planar surface, saving production costs of the fastener and horizontal planar surface.

Figure 16:
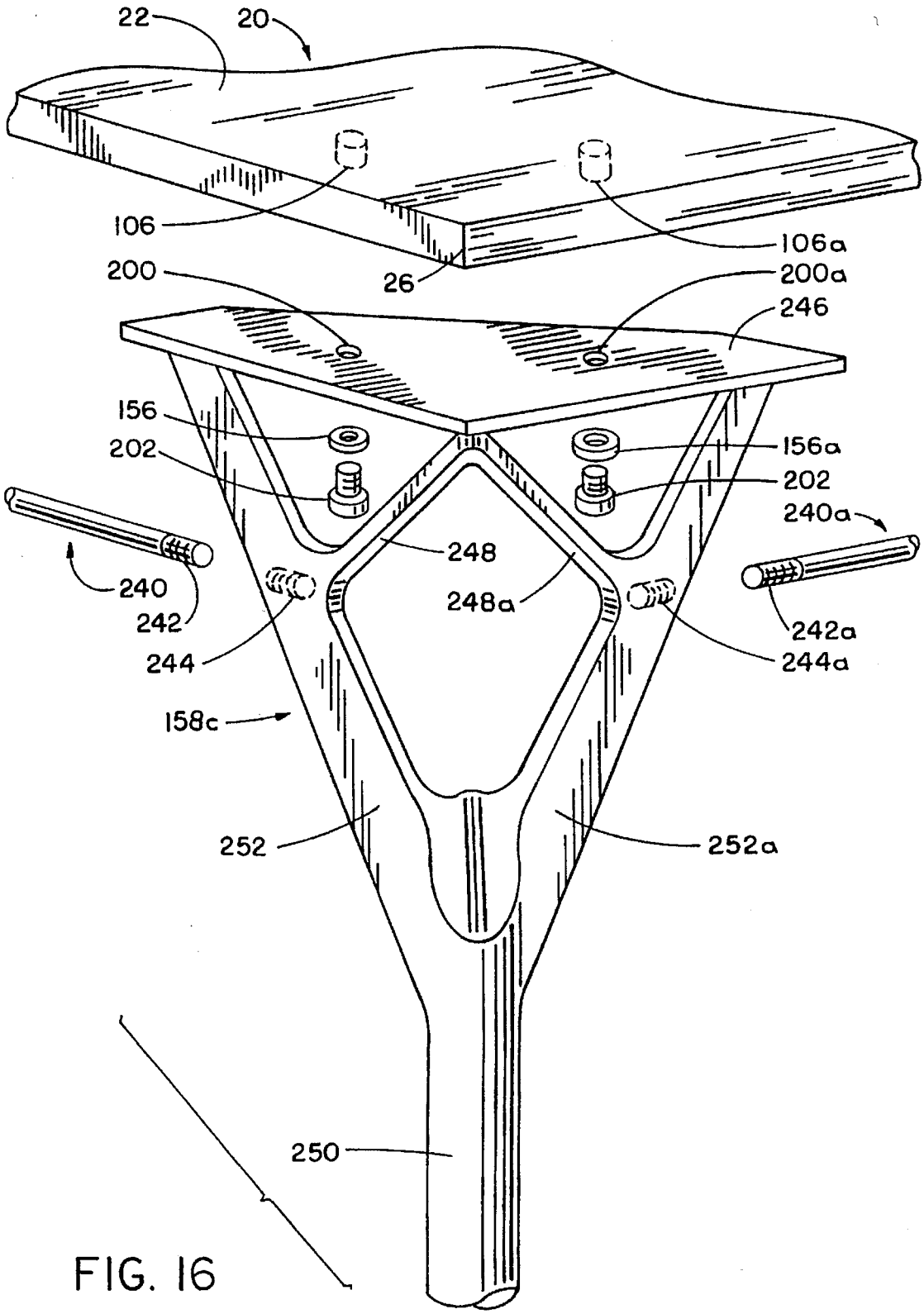
FIG. 16 is an exploded view showing a further alternative embodiment.

In FIG. 16, a cast metal fastener 158*c* integrates elongated side plates 252, 252*a*, elongated tension members 248, 248*a*, a leg support 250 and a horizontal top plate 246 in a single unit. Elongated side plate 252 or 252*a* in this embodiment has an inlet 244, 244*a* which is approximately centered horizontally and vertically. A rod 240, 240*a* is structured to engage in inlet 244, 244*a*, for example the rod having a threaded end 242, 242*a* for engaging a complementary thread in inlet 244, 244*a*. However, in order to effect assembly, the opposite ends of the rods and their corresponding threaded inlets must be oppositely threaded so that they can be assembled by turning the rods in one direction or the other to tighten both ends, in the manner of a turnbuckle.

Providing a single cast unit at each corner of the article of furniture saves production costs and facilitates assembly (or disassembly), because a minimum of separate parts are employed. A single unit also contributes to rigidity and structural integrity, maintaining a strong corner triangulation while providing an open structure for the corner at the legs. Tension members 248, 248*a*, which extend generally from a point adjacent to inlets 244, 244*a* to a point on horizontal plate 246 under corner 26 of planar support 22, provide additional triangular bracing and further contribute to the rigidity of the joint.

The joints and fasteners of the invention provide an economical, sturdy and reliable means for attaching and connecting support members and for distributing structural moment forces between and among the adjacent fasteners and from leg joint to leg joint. While the above description contains many specifics, the invention is not intended to be limited to the particular arrangements shown as examples. Other variations are possible within the scope of the invention as defined in the appended claims. For example, a high strength plastic could be used instead of the wood and or metal members, respectively. Cast or formed arrangements are possible. Alternative or additional fastening means are possible to replace the bolts and spacers. And in general, the relative dimensions, configurations and specific material selections for the respective members can be varied as appropriate for reasons of strength or aesthetics in a given case.

Examples of possible forms and configurations are as follows: elongated plates can be curved within the same plane as disclosed in the above embodiments or can be curved outside or inside the disclosed plane, elongated plates can have many curves producing a wave like appearance, attachment of elongated plates to the leg supports', side side supports' and horizontal planar supports' connection means can be closer to the outside or inside of their disclosed points of attachment, second piece of disclosed fastener in FIG. 4 can be eliminated providing the remaining piece is substantially thickened to increase rigidity. This remaining piece in FIG. 4 can provide attachment on the inside, outside or within the side supports. If attached within the side supports they can be adapted accordingly to receive the elongated plates.

I claim:

1. An article of furniture, comprising:

means defining a substantially planar support;

a plurality of legs disposed under the support and connected to the planar support by joint members, the legs having an upper end spaced below the planar support to define a gap between the upper end and the planar support;

the joint members comprising at least two bracing members coupled between respective ones of the legs and the planar support across the gap, said bracing members being inclined relative to each respective said leg and relative to the planar support, whereby the two bracing members and the planar support together define a triangle that leans laterally relative to a plane including said leg;

wherein said triangle has three sides formed by the two bracing members and the planar support, respectively, and said gap between the upper end of the leg and the planar support lacks a structural connection between the leg and the planar support apart from the bracing members, which bracing members space the upper end from the planar support such that the triangle exclusively structurally connects the leg with the planar support: and, side support members extending between the joint members of spaced pairs of the legs, the side support members coupling said pair of legs for distributing at least one of tension and compression forces between the legs of the pair.

2. The article of furniture of claim 1, wherein the pair of legs are adjacent legs and the side support members are connected to the bracing members of the adjacent legs.

3. The article of furniture of claim 2, wherein the side support members are coupled to the bracing members at a space below the planar support.

4. The article of furniture of claim 2, wherein the side support members are coupled to the joint members exclusively at the bracing members.

5. The article of furniture of claim 4, wherein each end of the side support members and the upper end of each associated one of the legs are spaced from one another at the joint members.

6. The article of furniture of claim 2, wherein the triangle defined by the two bracing members and the planar support leans laterally upward and inward of the article of furniture.

7. The article of furniture of claim 6, wherein the side support members are rigid against tension and compression.

8. The article of furniture of claim 2, wherein the side support members couple the legs via the joint members in a closed configuration having at least three legs.

9. The article of furniture of claim 2, wherein the side support members are cantilevered and have ends extending beyond their connections to the bracing members.

10. The article of furniture of claim 2, wherein the joint members each comprise at least two V-shaped elements attached to the planar support at ends of the V-shaped elements and attached to the associated leg at a bottom of the V-shaped elements.

11. The article of furniture of claim 10, wherein the V-shaped elements are arranged to straddle the side support members.

12. The article of furniture of claim 2, wherein the joint members include at least one socket for receiving at least one of the associated leg and the side members.

13. The article of furniture of claim 12, wherein the joint members are integrally cast.

14. The article of furniture of claim 12, further comprising at least one fastener extending through the socket.

15. The article of furniture of claim 12, wherein the socket is threaded.

16. The article of furniture of claim 2, wherein the side support members are disposed immediately under the planar support.

17. An article of furniture, comprising:

means defining a substantially planar support;

a plurality of legs disposed under the support and connected to the planar support by joint members, the legs having an upper end spaced below the planar support;

the joint members comprising at least two bracing members coupled between respective ones of the legs and the planar support, said bracing members being inclined relative to each respective said leg and relative to the planar support, whereby the two bracing members and the planar support together define a triangle that leans laterally relative to a plane including said leg;

side support members extending between the joint members of spaced pairs of the legs, the side support members coupling said pair of legs for distributing at least one of tension and compression forces between the legs of the pair;

wherein the pair of legs are adjacent legs and the side support members are connected to the bracing members of the adjacent legs; and, wherein the joint members each comprise a plurality of plates, rigidly coupled to one another to form an integral unit, two said integral units being attached to each of the legs to form the bracing members.

18. The article of furniture of claim 17, wherein said units each comprise a generally rectangular and vertical end plate beating against said leg at approximately a right angle to said planar support; a generally rectangular and horizontal end plate, bearing against said planar support substantially above said vertical end plates; and connection-element means extending between the vertical and horizontal end plates.

19. The article of furniture of claim 18, wherein the connection-element means extend in mutually perpendicular planes at approximately 45° to the planar support.

20. An article of furniture, comprising:

means defining a substantially planar support;

a plurality of legs disposed under the support and connected to the planar support by joint members, the legs having an upper end spaced below the planar support to define a gap between the upper end and the planar support;

the joint members comprising at least two bracing members coupled between respective ones of the legs and the planar support across the gap, said bracing members being inclined relative to each respective said leg and relative to the planar support, whereby the two bracing members and the planar support together form three sides of a triangle that leans laterally relative to a plane including said leg;

wherein said gap between the upper end of the leg and the planar support lacks a structural connection between the leg and the planar support apart from the bracing members, which bracing members space the upper end from the planar support such that the triangle exclusively structurally connects the leg with the planar support; and, a plurality of side support members extending between the joint members of spaced pairs of the legs, the side support members coupling adjacent legs in a closed configuration of at least three legs, for distributing at least one of tension and compression forces among the legs, the side support members being spaced below an underside of the planar support such that a vertical load on the planar support produces said at least one of tension and compression forces in the side support members.

* * * * *

UNITED STATES PATENT AND TRADEMARK OFFICE

CERTIFICATE OF CORRECTION

PATENT NO. : 5,638,762

DATED : June 17, 1997

INVENTOR(S) : Michael James Chestnutt

It is certified that error appears in the above-indentified patent and that said Letters Patent is hereby corrected as shown below:

In Column 3, line 40, delete "comer" and substitute therefor --corner--.
In Column 3, line 42, delete "comers" and substitute therefor --corners--.
In Column 3, line 45, delete "comer" and substitute therefor --corner--.
In Column 6, line 15, delete "comer" and substitute therefor --corner--.
In Column 6, line 29, delete "comer" and substitute therefor --corner--.
In Column 6, line 62, delete "comer" and substitute therefor --corner--.
In Column 7, line 1, delete "comer" and substitute therefor --corner--.
In Column 9, line 49, delete "comer" and substitute therefor --corner--.
In Column 10, line 44, delete "comer" and substitute therefor --corner--.
In Column 13, Claim 18, line 28, delete "beating" and substitute therefor --bearing--.

Signed and Sealed this

Thirtieth Day of December, 1997

*Attest:*

*Attesting Officer*

BRUCE LEHMAN

*Commissioner of Patents and Trademarks*